US005542224A

United States Patent [19]

Olsen

[11] Patent Number: 5,542,224

[45] Date of Patent: Aug. 6, 1996

[54] LOUVER

[75] Inventor: Robert W. Olsen, Washington, N.J.

[73] Assignee: Construction Specialties, Inc., Cranford, N.J.

[21] Appl. No.: 359,051

[22] Filed: Dec. 19, 1994

[51] Int. Cl.[6] ..... E06B 7/08

[52] U.S. Cl. ..... 52/473; 52/656.8; 454/277; 454/279

[58] Field of Search ..... 52/473, 656.8, 52/663, 793.11, 799.1, 799.11; 256/22; D25/100, 101; 29/160; 160/172 V, 236; 49/74.1, 77.1; 454/224, 277, 279

[56] References Cited

U.S. PATENT DOCUMENTS

| | | | |
|---|---|---|---|
| 1,673,906 | 6/1928 | Fager | 52/473 |
| 1,960,629 | 5/1934 | Green | 52/473 |
| 1,995,456 | 3/1935 | Kannel | 29/160 |
| 2,618,821 | 11/1952 | Corn | 52/473 |
| 2,802,551 | 8/1957 | Roberts | 52/473 |
| 3,303,622 | 2/1967 | Minds, Jr. | 52/473 |
| 3,348,466 | 10/1967 | Lane et al. | 454/277 |
| 3,358,580 | 12/1967 | Freese et al. | 454/277 |
| 3,625,136 | 12/1971 | Dininno | 52/473 |
| 4,335,797 | 6/1982 | Simmons | 52/473 |

*Primary Examiner*—Michael Safavi
*Attorney, Agent, or Firm*—Brumbaugh, Graves, Donohue & Raymond

[57] ABSTRACT

A louver has vertical blades arranged in a frame alternately in a staggered relation from front to back in a front and a rear row. The blades in at least the front row have a web oriented substantially perpendicularly to the plane of the frame and substantially parallel to the jambs, a pair of front flanges extending in opposite directions generally laterally from a front edge of the web, and a pair of rear flanges extending in opposite directions generally laterally from a rear edge of the web. The webs subdivide the air flow volume within the frame into flow channels, each of which is partially blocked laterally by the front flanges and the rear flanges of the blades of the front row. The blades of the rear row have flanges that block the portions of the channels between the extremities of the flanges of the blades of the front row. The flanges of the adjacent blades overlap so that there is no straight path through the flow channels along which air and water entrained in the air can pass perpendicularly to the plane of the frame and the air flows along a tortuous flow path of approximately constant area. The flanges are configured to control and trap water impinging on them.

30 Claims, 6 Drawing Sheets

LOUVER

BACKGROUND OF THE INVENTION

It is often desirable in a louver installation to prevent to the utmost extent wind-driven rain water from passing through the louver (i.e., to prevent "water carry-over") from the outside environment into a duct or a space on the opposite side of the louver from the environment. Often, horizontal blade louvers of the drainable type are used, inasmuch as they have relatively low air flow pressure drops. In particular, they can be designed to minimize turbulence, a major source of pressure drop.

Vertical blade louvers can be designed to minimize water carry over by causing the flow to change direction as it passes through the louver and in so doing cause the rain drops to impinge upon and be captured by blade surfaces that generally face a portion of the flow path. One or more portions of the blades of vertical blade louvers can have projecting flanges to capture water driven along an adjacent surface and provide a vertical gutter along which the captured water flows to the sill. An unavoidable trade-off for inducing changes in the direction of flow through a louver is an increased pressure drop. In many situations, the trade-off is an acceptable one.

SUMMARY OF THE INVENTION

An object of the present invention is to provide a vertical blade louver that is highly effective in preventing water carry over.

The foregoing and other objects are attained, in accordance with the present invention, by a louver that includes a rectangular frame having a header, a sill, and jambs joining opposite ends of the sill and header, the frame defining a volume open at parallel front and rear planes for passage of air through the louver. A multiplicity of laterally spaced-apart front blades extend between and are joined to the sill and header, each front blade being of substantially uniform cross-section throughout its length and including a web extending vertically between the sill and header and oriented generally perpendicular to the front and rear planes. The webs subdivide the volume within the frame into channels. A pair of front flanges extend in opposite directions generally laterally from a front part of the web, and a pair of rear flanges extend in opposite directions generally laterally from a rear part of the web. The flanges partially block the channels in the transverse direction. A multiplicity of laterally spaced apart rear blades, which also extend vertically between and are joined to the sill and header, have flanges that block the remainder of each channel between the webs of the front blades in the lateral direction. In that regard, the front and rear blades are positioned with respect to each other laterally such that the flanges of each rear blade partially overlap the front flanges of the adjacent front blades.

The configuration and arrangement of the blades in two rows, one staggered with respect to the other and with the flanges of adjacent blades overlapping has several effects. First, there is no unobstructed straight path perpendicular to the front and rear planes of the flow volume along which air and entrained water drops can pass directly through the louver. In addition, the air passing through the louver must change direction and in so doing will tend to divert entrained water drops with a component of velocity in a lateral direction. The momentum of the laterally diverted water drops will carry them toward a blade surface, on which they will impinge and be captured. Second, all air entering the louver, regardless of the angle at which it enters, will encounter the surface of a blade of either the front row or the rear row. Rain drops entrained in the air impinge on the blade surfaces, lose velocity, and fall by gravity. Some of the water will be captured by blade surfaces upon which they first impinged. To some extent, depending on the direction in which they impinge, drops will become re-entrained in the flow, and they will splash and be thereby formed into smaller droplets. The re-entrained drops and droplets will, however, encounter additional blade surfaces by virtue of the tortuous flow path produced by the overlapping of the flanges of each adjacent pair of blades between the front and rear planes and will eventually be captured on a surface and flow by gravity onto the sill, from which the water is drained away. Third, the velocity of the air flow is quickly reduced upon encountering a succession of blade surfaces along the tortuous flow path. As the flow velocity is reduced and small eddy currents are formed as a result, re-entrainment of water diminishes and water capture on blade surfaces increases.

In preferred embodiments, adjacent blades are configured and positioned with respect to each other such that the extremities of their flanges define flow path areas that are of generally equal size. That is accomplished by maintaining approximately equal spacings between the portions of the flanges of each adjacent pair of blades that are closest to each other. A generally equal flow area will minimize losses and enhance air flow efficiency.

In preferred embodiments, the blade flanges are configured to control water that collects on them and is carried along their surfaces by the air flow. In one form of control, the front flanges of the blades each have a lateral edge part that is generally J-shaped in cross-section and includes a hook portion, each hook portion having a convex surface facing generally away from the web so that water is carried around the convex surface and is released from the surface in a direction generally toward the web so that it will impinge on the web and be captured.

In another form of control of water capture by the blades, each of the flanges of some or all of the blades has a lateral edge part that is generally J-shaped in cross-section and includes a hook portion, each hook portion having an opening facing generally toward the front plane and serving as a channel to trap water and drain it to the sill. Ordinarily, all of the blades have rear flanges of that configuration to ensure that water is captured and not blown off the edge of the flange.

Some or all of the blades may, optionally, have one or more pairs of ribs extending generally laterally from the web in opposite directions from each other at locations intermediate of the front and rear flanges. Where provided, the ribs are located relative to the flanges of adjacent blades to further define areas of the flow paths that are approximately equal to the areas defined between the flanges of adjacent blades. Similarly, except for no more than two blades adjacent each jamb, all adjacent blades in each row are, preferably, substantially equally spaced apart laterally and the spacing of adjacent blades in the front row is the same as the spacing of the blades in the rear row, thereby providing uniform flow conditions across the width of the louver.

It is desirable to provide a flashing member having a base portion under the sill and an upright flange portion behind the sill and to configure the sill and the flashing so that they define a space and to provide drainage holes in the sill near the rear plane for water to drain from the upper surface of the sill into the space. Provision is made for water to drain from the space under the sill.

For a better understanding of the invention, reference may be made to the following description of exemplary embodiments, taken in conjunction with the accompanying drawings.

DESCRIPTION OF THE EMBODIMENTS

Figure 1:
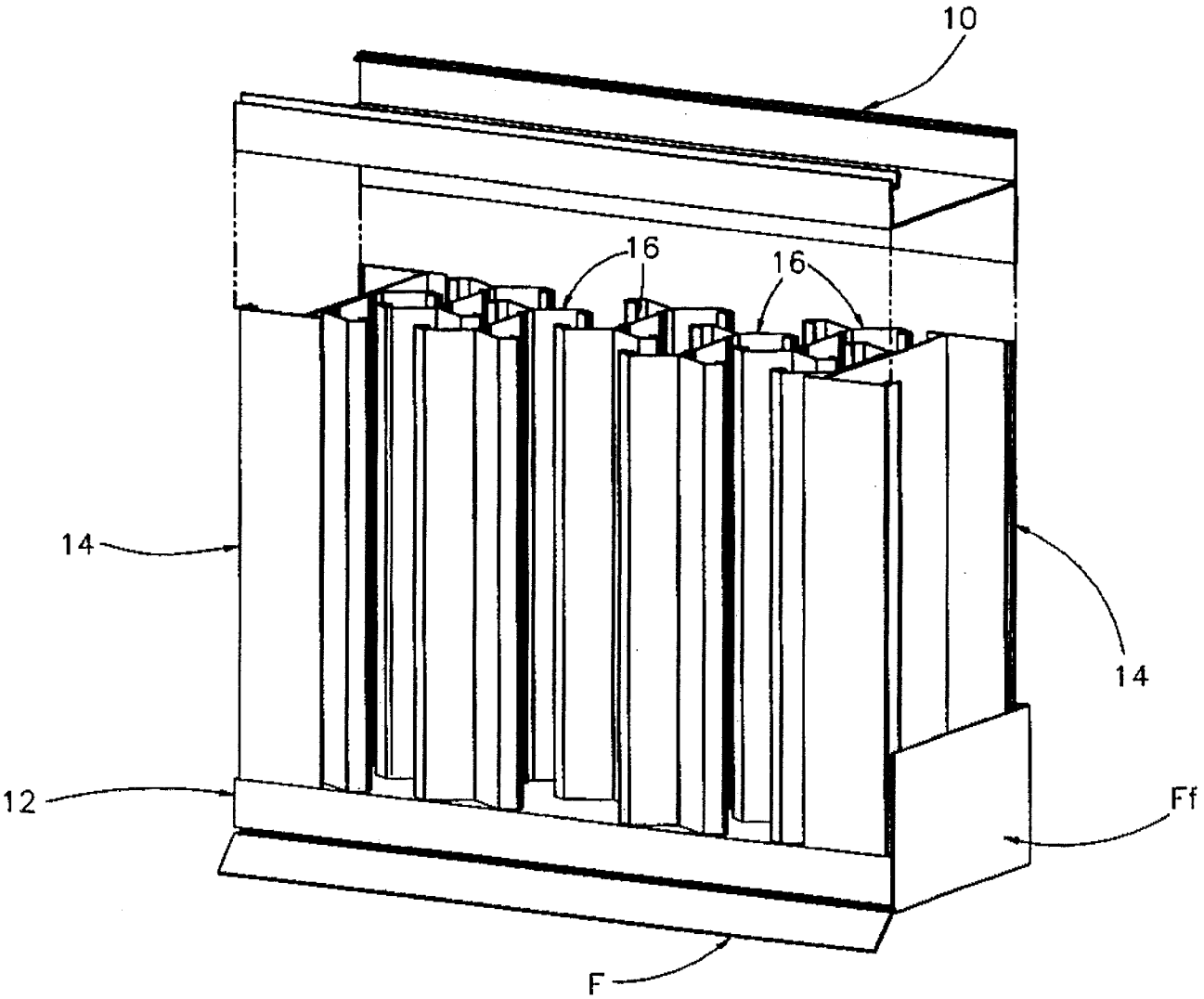
FIG. 1 is a partially exploded front three-quarter pictorial view of one embodiment.
Figure 2:
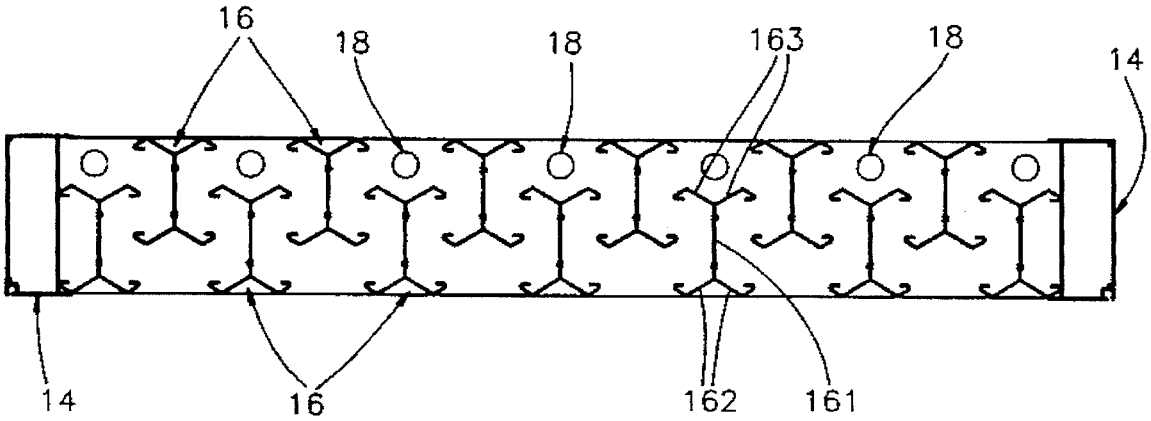
FIG. 2 is a top plan view of the embodiment shown in FIG. 1, with the header removed.
Figure 3:
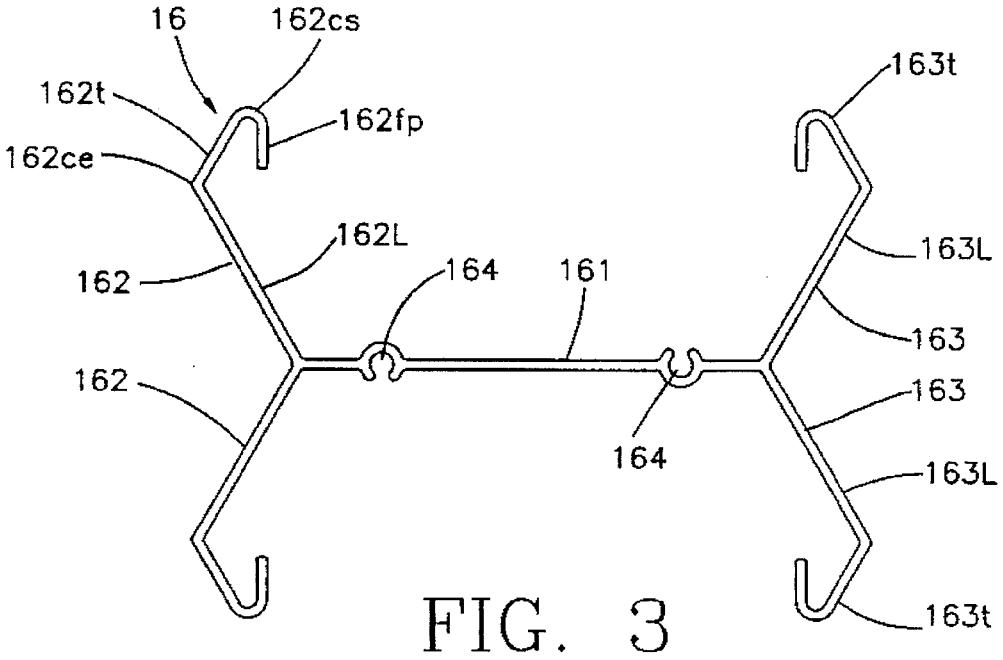
FIG. 3 is an end view of a blade of the embodiment of FIGS. 1 and 2, the view being on an enlarged scale relative to FIG. 2.

A louver according to one embodiment of the present invention, as shown in FIGS 1 to 3, comprises a rectangular frame having a header 10, a sill 12, and jambs 14 joining opposite ends of the sill and header. The frame defines a volume open at parallel front and rear planes for passage of air through the louver. A multiplicity of elongated blades 16 extend vertically between and are joined to the sill and header. The design of the header, sill and jambs may vary. In the embodiment, the sill and header are extruded members of the same cross section and have a channel-shaped body portion and a rear flange portion. The jambs 14 are also of the same cross section and are channel-shaped. The front flanges of the sill, header and jambs have small grooves for a field-placed caulking.

All of the blades 16 of the embodiment of FIGS. 1 to 3 are identical. Each blade 16 is of substantially uniform cross-section throughout its length and has in cross-section (see FIG. 3) a planar web 161, which is oriented substantially perpendicularly to the front and rear planes and substantially parallel to the jambs 14, a pair of front flanges 162 extending in opposite directions generally laterally from a front edge of the web, and a pair of rear flanges 163 extending in opposite directions generally laterally from a rear edge of the web 161. Each flange 162 and 163 is generally J-shaped and is oriented with its leg portion (e.g., 162L) oriented obliquely to the web portion 161 such that the leg portions at each end (in cross section) of the web portion form a "V." The junctures of the leg portions with the tip portions (e.g., 162L with 162*t*) form a sharp corner edge 162*ce*. The laterally outermost extremities of each flange portion form a smoothly rounded convex surface (e.g., 162*cs*) and each tip portion turns in at the end back toward the web portion in a terminal flange portion (e.g., 162*fp*).

Screw bosses 164 are formed on the web portion 161 and receive screws (not shown) that pass into the bosses though holes in the sill and header. The blades of the embodiment of FIGS. 1 to 3 are pieces cut to the desired lengths from extrusions, preferably of aluminum. As may be seen in FIG. 2, the blades 16 are arranged in staggered relation with respect to the front and rear planes, with every other blade being closer to the front plane than the remaining blades, and are positioned with respect to each other laterally such that the front flanges 162 of adjacent blades partially overlap so that there are no straight paths perpendicular to the front and rear planes along which air and water entrained in the air can pass through the louver unobstructed. In order to maximize the free area, the amount of overlap is, preferably kept small, say ⅛th inch.

Figure 4:
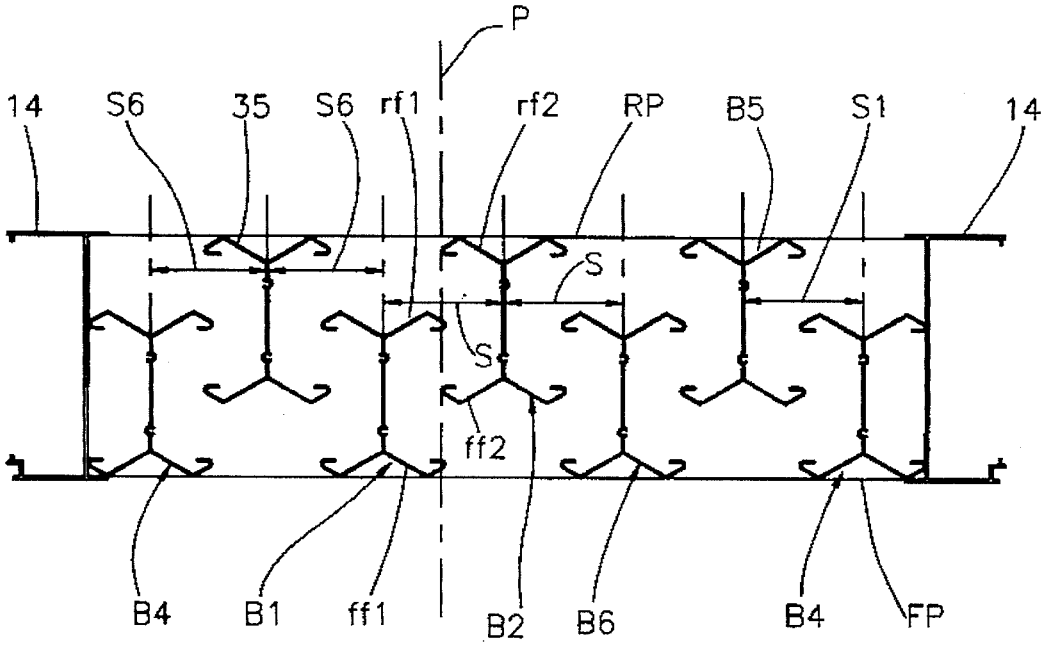
FIG. 4 is a partial diagrammatic top plan view that shows an installation in which the blade adjacent each jamb engages the jamb.

FIG. 4 shows a plane P perpendicular to the front and rear planes FP and RP of the louver and to the sill and header of the frame. The plane P intersects the tips of the front flange ff1 of one blade B1 and the front flange ff2 of an adjacent blade B2.

Figure 5:
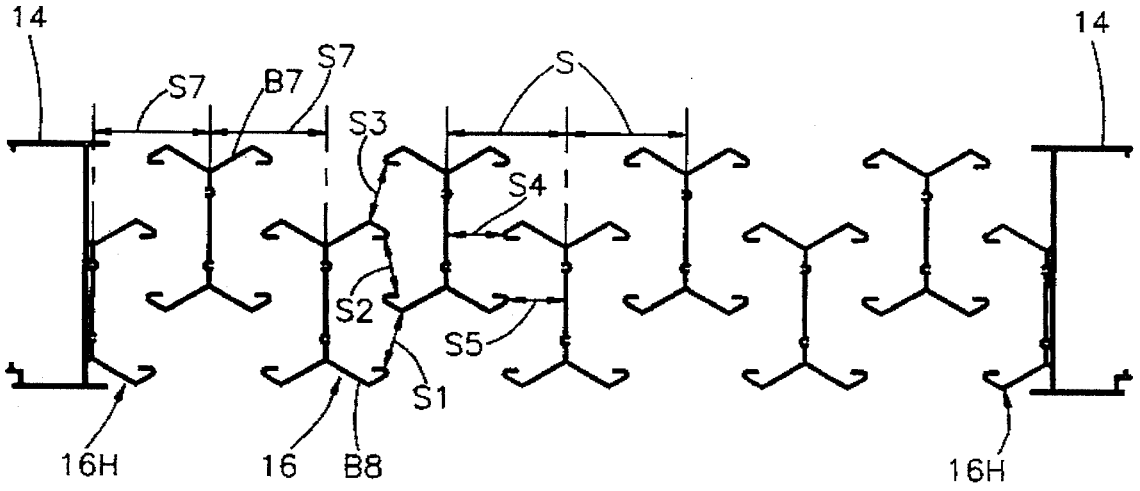
FIG. 5 is a partial diagrammatic top plan view that shows an installation in which a half-blade is installed on each jamb.

The spacings S of the blades in each row (the respective front and back rows) are the same, and the front row of blades is arranged with respect to the back row of blades such that the closest distances between the blade flanges of adjacent blades are approximately the same. That is, the spacings S1, S2 and S3 marked on FIG. 5 are nearly the same. The reason for this is to maintain as large a free area as possible for any given blade size. Similarly, the spacings S4 and S5 between the web of each blade and the nearest to it is maintained approximately equal to the spacings S1, S2, and S3 between the blade edges. Accordingly, the free area of each tortuous flow path formed by each adjacent pair of blades is approximately constant throughout its extent through the louver.

The width of the frame between the jambs 14 can be varied to meet the desired size of the opening in which the louver is to be installed by changing the spacings of blades nearest each jamb and by using half blades. In FIG. 4, the blade B4 immediately adjacent each jamb 14 is installed with its flange portions in engagement with the jamb 14. The blades B5 and B1 next in from the jamb are placed at any desired spacing S6, but always with the small overlap between the front flanges, as described above. When the desired size falls between the limits of changing the spacing S6, half blades 16H (FIG. 5) are used at each jamb. As before, additional width variations are made by changing the spacings S7 between the half blade 16H and the next two blades B7 and B8 in from it. In all instances, the rest of the blades (all of the blades other than one or two blades adjacent each jamb) are installed at the same spacing S.

Figure 6:
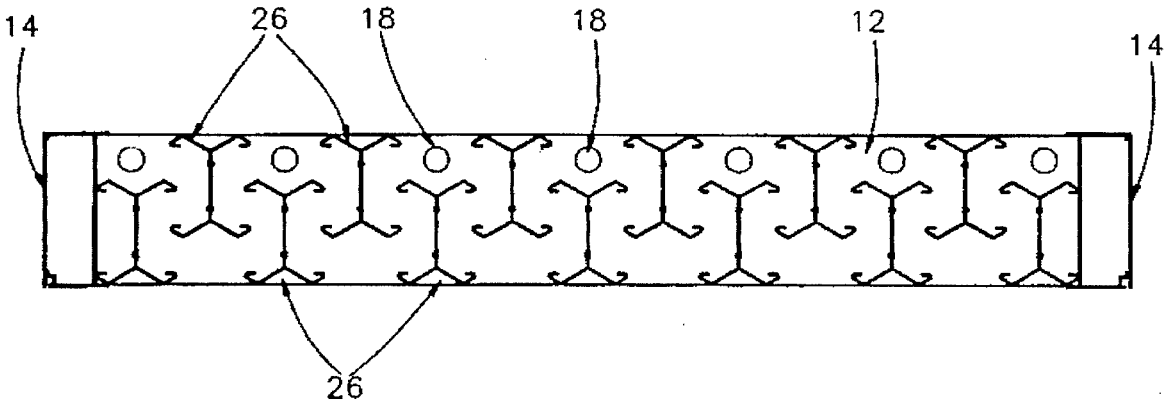
FIG. 6 is a top plan view of an embodiment in which the blades are brake-formed.
Figure 7:
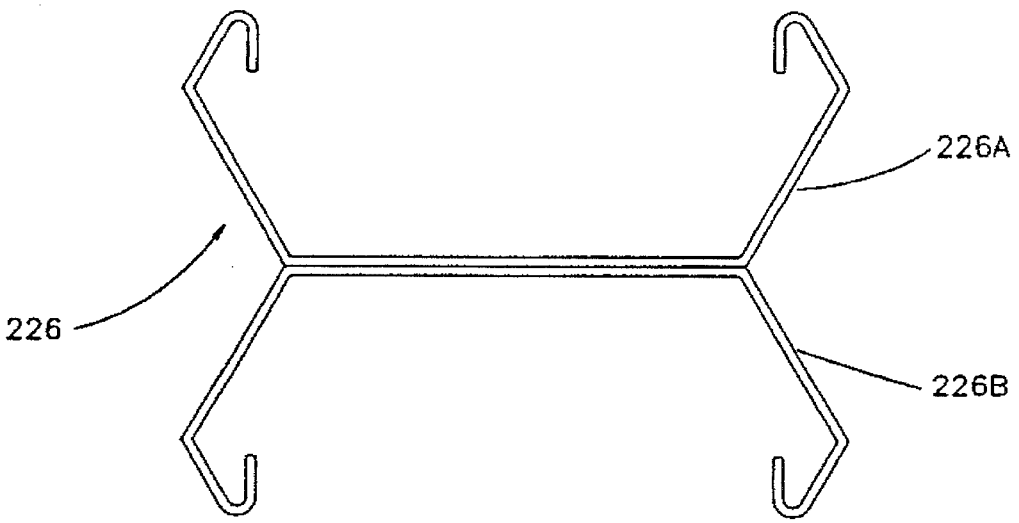
FIG. 7 is an end view of a blade of the embodiment of FIG. 6 on a larger scale.

The blades 226 of the embodiment shown in FIGS. 6 and 7 are similar in configuration to those of the embodiment of FIGS. 1 to 5 but are made by brake-forming from sheet metal, such as aluminum sheet. Each blade consists of two sheet metal members 226A and 226B, each of generally channel-shaped cross section, suitably joined back to back (FIG. 7). The overall shapes of the blades and their positions in the frame are essentially the same as those of the blades of FIGS. 1 to 5. The blades are attached to the sill and header by slitting each end of the blade parts to form several tabs (not shown), which are bent out on either side of the blade and fastened by rivets or screws to the sill and header.

In an exemplary design of the louver with extruded blades according to FIGS. 1 to 5, the blades are 3.125 inches wide and 4.164 inches deep at their extremities and 0.060 inches in thickness throughout and are installed at 6.00 inches on center in each row. The break-formed blades are 2.84 inches wide by 6.125 inches deep and are made of 0.040 inch thick sheet aluminum sheet. They are installed at 5.750 inches on center.

When wind-blown rain impinges on the louver exactly perpendicular to the front plane, much of it impinges directly on a frontal surface of a front flange portion 162 of a blade of either the front row or the back row, inasmuch as the flanges of the front blades overlap the flanges of the back blades. Some of the water collects on the frontal surfaces, and some of the water drops are formed into droplets by splashing. Water that collects on or splashes into droplets against the surfaces of the divergent leg portions 162*l* is pushed back against the apex at the juncture between them and flows down to the sill. Droplets that become re-entrained may be picked up in the air flow and will be handled as described below. Drops that impinge on the portions 162*t* are largely deflected as splash; most of the water that collects on the portions 162*t* clings to and is blown around the convex surface 162*cs* and flows down the terminal flange portion 162*fp* to the sill.

Drops entering the louver that are diverted by the air flow, which acquires a lateral component in order to pass between adjacent blade flanges 162, and droplets from splash that become entrained in the air flow are carried predominantly onto a web portion 161 and a rear flange portion 163 of a blade in the front row and cling to and flow down the portion on which they impinge to the sill. Any additional splash and any droplets that remain entrained after passing the front flange 162 of a blade in the back row are diverted in the direction of the web portion 161 and rear flange portion 163 of a blade in the back row, where they are captured and flow down to the sill. The tip portions 163*t* of each rear flange 163 of each blade form a channel, which catches all water collecting on a web portion 161 and a rear flange leg portion 163*l* that is blown along the blade by the air flow. The water caught in the channels drains to the sill.

When the wind is oblique to the front plane of the louver, the rain drops and droplets from splash that pass between the front flanges of adjacent blades impinge on the web portion 161 of a blade in the front row. Much of that water is collected and flows down the web portion or is carried by the air flow into the channel formed by the tip portion 163*t* of a rear flange portion of a blade in the front row and flows to the sill. Any droplets that become entrained in the air flow impinge on the web portion 161 or flange portion 163 of a blade in the back row and are collected and flow to the sill. The tortuous flow path formed by the four flange portions between adjacent webs ensures that no water can reach the space behind the louver—there is no water carryover.

A suitable way of installing the louver in an opening is to provide flashing F under the sill (see FIG. 1), the flashing being formed into an "L" having a base portion under the sill, an upright rear flange portion behind the sill (not visible), and side flange portions FF adjacent the lower portion of each jamb. The base portion of the flashing defines a drainage space under the jamb, and the jamb has drainage holes 18 (see FIGS. 2 and 6) near the rear plane for water to drain from the upper surface of the sill into the space between the flashing and the sill. An outlet from the space under the sill is provided for water to drain from the space.

Figure 8:
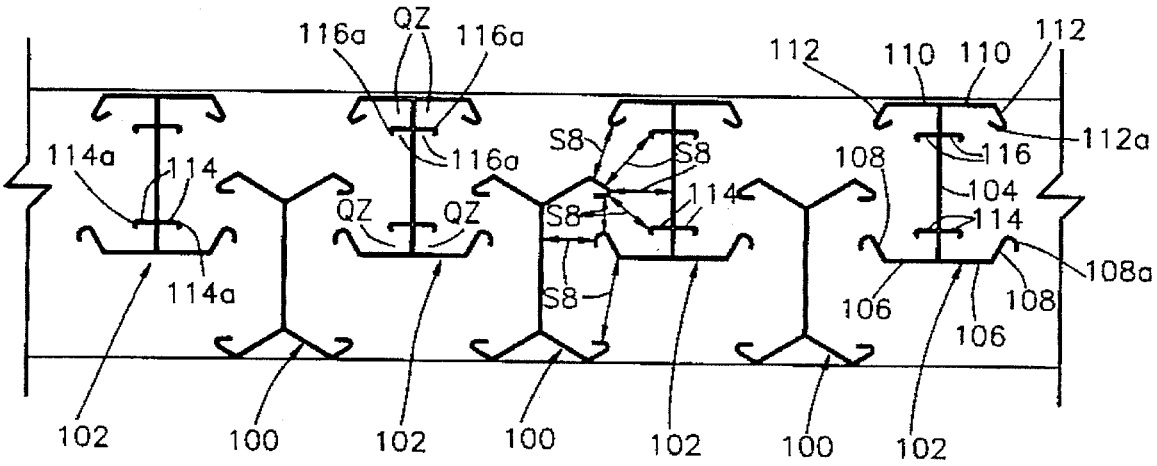
FIGS. 8 to 10 are top plan views of three other embodiments, each having blades of different configurations, which are shown in generally schematic form.
Figure 9:
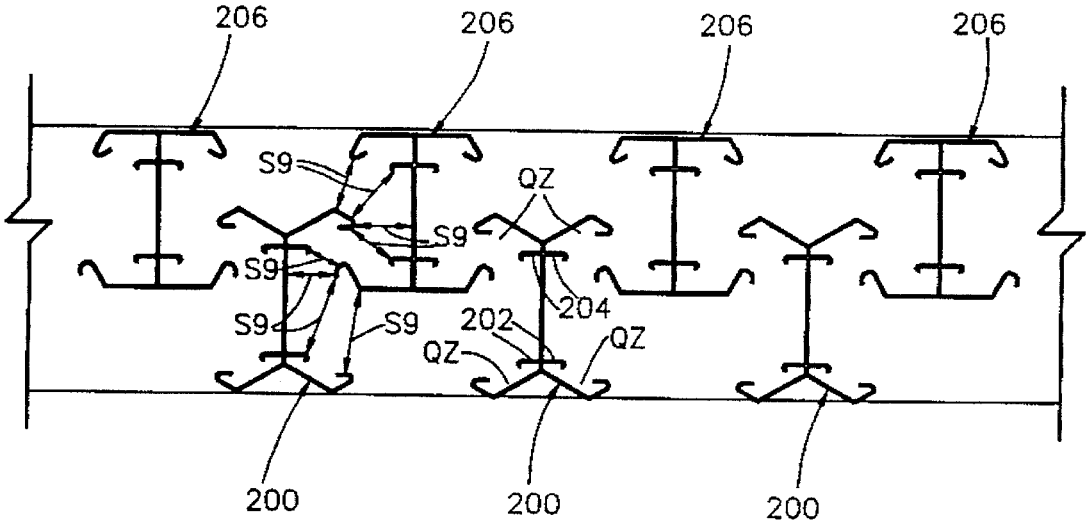
Figure 10:
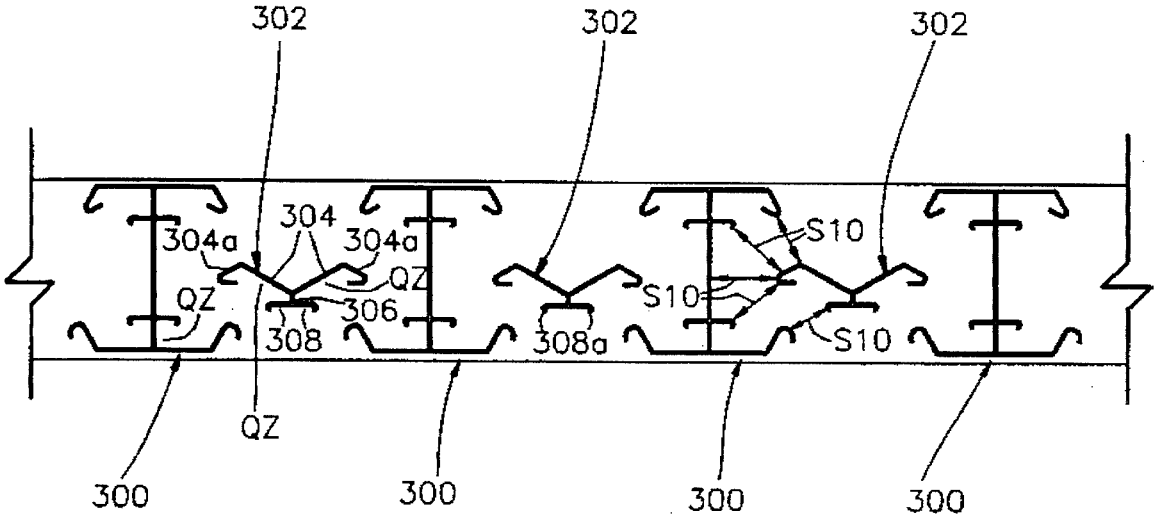

The louvers shown in FIGS. 8 to 10 are exemplary of modifications of the embodiment of FIGS. 1 to 7 that are possible and that have the main features of the invention, namely, two staggered rows of blades, flanges at the front of blade in the rear row that overlap the front flanges of the blades in the front row so that there is no straight, perpendicular flow path from front to rear, blade configurations and spacings that provide tortuous flow paths with generally equal areas between the extremities of the blade flanges nearest each other and between blade extremities and webs nearest to them, and control of surface water flow on the blade surfaces.

The louver of FIG. 8 has a front row of blades 100, which are the same as the blades 16 of the embodiment of FIGS. 1 to 5, and a rear row of blades 102 of a different cross-sectional shape. Each blade 102 has a web portion 104 and a pair of flat front flanges 106, each of which has at its distal end a generally J-shaped edge part 108, the curved portion 108*a* of which has an opening that faces toward the front of the louver to define a channel for trapping water blown along the surface of the flange and draining it to the sill. Each of a pair of planar rear flanges 110 has and edge part 112, which is also generally J-shaped with an opening in the hook portion 112*a* that faces generally toward the web portion to capture water and drain it to the sill.

As a flow of air leaves the edge of a surface, eddies are formed in the wake of the surface. The average or main air flow through the louver follows the tortuous open paths, but eddies generated at the edges of surfaces at the boundaries of the main flow migrate out of the main flow, if there is space available for them to migrate into. The blades 102 of the rear row have pairs of ribs, which promote formation of small eddies at the boundaries of the main air flow, provide surfaces for water entrained in the eddies to collect on, and form quiet zones at least partially shielded from the main air flow that reduce the tendency of water to become reentrained in the air flow. The ribs are configured and placed, however, so that their extremities (edges) are spaced apart from the edges of the blade flanges nearest to them at approximately the same distance as the edges of the blade flanges are spaced from the flanges nearest to them, thus to maintain generally the same cross-sectional area for the main flow.

In particular, the blades 102 have a pair of front ribs 114 located proximate to the front flanges 106 and a pair of rear ribs 116 located proximate to the rear flanges 110. The spacings S8 marked in FIG. 8 are approximately the same. The arrowed lines indicating the spacings S8 also indicate generally the path of the main air flow. Each rib has an edge flange portion 114*a*, 116*a* that extends toward the front of the louver and promotes capture of water collecting on the surface of the rib and drainage down to the sill. The regions marked QZ of each rear blade are quiet zones into which eddies can migrate, contact the surfaces bounding them, and deposit entrained water drops and droplets on those surfaces.

The embodiment of FIG. 9 has front blades 200 that are similar to those of FIGS. 1 to 7 but have front ribs 202 and rear ribs 204 that serve the purposes described immediately above. The rear blades 206 are the same as those of FIG. 8. The spacings S9 are generally equal, and the quiet zones are marked QZ.

FIG. 10 illustrates an embodiment in which the front blades 300 are the same as the rear blades 110 and 206 of the embodiments shown in FIGS. 8 and 9 and the rear blades 302 have no web portion or rear flanges. A single pair of flanges 304 extend generally laterally from a juncture 306 and block the spaces between the front flanges of the adjacent front blades 300. A pair of ribs 308 extend from the juncture 306 and are located in front of portions of the flanges and form quiet zones QZ into which eddies formed in the wakes of the tips of the ribs migrate and deposit entrained water on the surfaces bounding the quiet zones. Edge flange portions 308*a* on each rib keep water that collects on the fronts of the flanges from blowing off the edges of the ribs and promote drainage down the ribs to the sill. Each flange 304 has a J-shaped edge portion 304*a* that opens generally toward the juncture and serves as a channel for capturing water and draining it to the sill. The spacings S10 indicated by the arrowed lines are approximately equal in order to maintain a tortuous flow path through the louver that is of approximately uniform area.

I claim:

1. A louver comprising a rectangular frame having a header, a sill, and jambs joining opposite ends of the sill and header, the frame defining a volume open at parallel front and rear planes for passage of air through the louver, a multiplicity of laterally spaced-apart front blades extending between and joined to the sill and header, each front blade being of substantially uniform cross-section throughout its length and including a web extending vertically between the sill and header and oriented generally perpendicular to the front and rear planes, a pair of front flanges extending in opposite directions generally laterally from a front part of the web and a pair of rear flanges extending in opposite directions generally laterally from a rear part of the web, a multiplicity of rear blades extending between and joined to the sill and header, each rear blade being laterally spaced apart from and located laterally between an adjacent pair of the front blades, and each rear blade being of substantially uniform cross-section throughout its length and having a pair of flanges extending laterally from a substantially vertical juncture, the front blades and rear blades being arranged in staggered relation with respect to the front and rear planes such that the flanges of the rear blades are located between the front and rear flanges of the front blades and the front flanges of each front blade are closer to the front plane than the flanges of each rear blade, and the front and rear blades being positioned with respect to each other laterally such that each flange of each rear blade partially overlaps a front flange of an adjacent front blade.

2. A louver according to claim 1 wherein each front flange of each of the front blades has a lateral edge part that is generally J-shaped in cross-section and includes a hook portion, each hook portion having a convex surface facing generally away from the web so that water is carried around the convex surface and is released in a direction generally toward the web.

3. A louver according to claim 1 wherein each front flange of each of the front blades has a lateral edge part that is generally J-shaped in cross-section and includes a hook portion, each hook portion having an opening facing generally toward the front plane and serving as a channel to trap water and drain it to the sill.

4. A louver according to claim 1 wherein each rear flange of each of the front blades has a lateral edge part that is generally J-shaped in cross-section and includes a hook portion, each hook portion having an opening facing generally toward the web and serving as a channel to trap water and drain it to the sill.

5. A louver according to claim 1 wherein except for not more than two blades adjacent each jamb all adjacent blades are approximately equally spaced apart laterally and the spacing of adjacent front blades is the same as the spacing of adjacent rear blades.

6. A louver according to claim 1 wherein adjacent blades are positioned with respect to each other such that the extremities of their flanges define flow path areas that are of approximately equal areas.

7. A louver according to claim 1 wherein each front blade has at least one pair of ribs extending generally laterally from the web in opposite directions from each other at a location intermediate of the front and rear flanges.

8. A louver according to claim 1 wherein each front blade has a pair of front ribs extending generally laterally from the web in opposite directions from each other at a location proximate to the front flanges and a pair of rear ribs extending generally laterally from the web in opposite directions from each other at a location proximate to the rear flanges.

9. A louver according to claim 1 wherein each rear blade has a pair of ribs extending generally laterally in opposite directions from each other at a location proximate to the flanges.

10. A louver according to claim 1 wherein each front blade has a pair of front ribs extending generally laterally from the web in opposite directions from each other at a location proximate to the front flange and a pair of rear ribs extending generally laterally from the web in opposite directions from each other at a location proximate to the rear flanges, and each rear blade has a pair of ribs extending generally laterally in opposite directions from each other at a location proximate to the flanges, the flanges and ribs of adjacent front and rear blades having distal ends defining a tortuous open flow path through the volume in which the areas defined between adjacent distal ends are of approximately the same area.

11. A louver comprising a rectangular frame having a header, a sill, and jambs joining opposite ends of the sill and header, the frame defining a volume open at parallel front and rear planes for passage of air through the louver, a multiplicity of blades extending between and joined to the sill and header, each blade being of substantially uniform cross-section throughout its length and having in cross-section a web oriented substantially perpendicularly to the front and rear planes and substantially parallel to the jambs, a pair of front flanges extending in opposite directions generally laterally from a front portion of the web, and a pair of rear flanges extending in opposite directions generally laterally from a rear portion of the web, the blades being arranged in staggered relation with respect to the front and rear planes so as to form a front row of blades and a rear row of blades, the front flanges of the blades of the front row being closer to the front plane than the front flanges of the rear row of blades, the blades being positioned with respect to each other laterally such that one front flange of each blade in the rear row partially overlaps a front flange of an adjacent blade in the front row, and the blades being positioned relative to each other with respect to the front and rear planes such that edges of the flanges of adjacent blades define flow cross-sections of approximately equal areas.

12. A louver according to claim 11 wherein each front flange of each of the blades in the front row is generally J-shaped in cross-section and includes in cross section a hook portion at its lateral extremity, each hook portion having a convex surface facing generally away from the web so that water is carried around the convex surface and is released in a direction generally toward the web.

13. A louver according to claim 11 wherein each front flange of each of the blades in the rear row is generally J-shaped in cross-section and includes a hook portion at its lateral extremity, each hook portion having a convex surface facing generally away from the web so that water is carried around the convex surface and is released in a direction generally toward the web.

14. A louver according to claim 11 wherein each front flange of each of the blades in the front row has a lateral edge part that is generally J-shaped in cross-section and includes a hook portion at its lateral extremity, each hook portion having an opening facing generally toward the front plane and serving as a channel to trap water and drain it to the sill.

15. A louver according to claim 11 wherein each front flange of each of the blades in the rear row has a lateral edge part that is generally J-shaped in cross-section and includes a hook portion at its lateral extremity, each hook portion having an opening facing generally toward the front plane and serving as a channel to trap water and drain it to the sill.

16. A louver according to claim 11 wherein each rear flange of each of the blades in the front row has a lateral edge part that is generally J-shaped in cross-section and includes a hook portion, each hook portion having an opening facing generally toward the web and serving as a channel to trap water and drain it to the sill.

17. A louver according to claim 11 wherein each rear flange of each of the blades in the rear row has a lateral edge part that is generally J-shaped in cross-section and includes a hook portion, each hook portion having an opening facing generally toward the web and serving as a channel to trap water and drain it to the sill.

18. A louver according to claim 11 wherein except for not more than two blades adjacent each jamb all adjacent blades are substantially equally spaced apart laterally and the spacing of adjacent blades in the front row is substantially the same as the spacing of adjacent blades in the rear row.

19. A louver according to claim 11 wherein each blade in the front row has at least one pair of ribs extending generally laterally from the web in opposite directions from each other at a location intermediate of the front and rear flanges.

20. A louver according to claim 11 wherein each blade of the front row has a pair of front ribs extending generally laterally from the web in opposite directions from each other at a location proximate to the front flange and a pair of rear ribs extending generally laterally from the web in opposite directions from each other at a location proximate to the rear flange.

21. A louver according to claim 11 wherein each blade of the front row has a pair of front ribs extending generally laterally from the web in opposite directions from each other at a location proximate to the front flange and a pair of rear ribs extending generally laterally from the web in opposite directions from each other at a location proximate to the rear flange, each rib of the blades of the front row defining with a flange of an adjacent blade of the rear row a flow path cross-section approximately equal in area to the flow path cross sections defined by edges of the flanges of the blades.

22. A louver according to claim 11 wherein each blade in the rear row has at least one pair of ribs extending generally laterally from the web in opposite directions from each other at a location intermediate of the front and rear flanges.

23. A louver according to claim 11 wherein each blade of the rear row has a pair of front ribs extending generally laterally from the web in opposite directions from each other at a location proximate to the front flange and a pair of rear ribs extending generally laterally from the web in opposite directions from each other at a location proximate to the rear flange.

24. A louver according to claim 11 wherein each blade of the rear row has a pair of front ribs extending generally laterally from the web in opposite directions from each other at a location proximate to the front flange and a pair of rear ribs extending generally laterally from the web in opposite directions from each other at a location proximate to the rear flange, each rib of each blade of the rear row defining with a flange of an adjacent blade of the front row a flow path cross-section area approximately equal in area to the flow path cross sections defined by edges of the flanges of the adjacent blades.

25. A louver according to claim 11 wherein adjacent blades are configured and positioned with respect to each other such that the shortest distances between each flange and the flange nearest to it are approximately equal.

26. A louver according to claim 11 wherein the blades are configured and positioned with respect to each other such that the shortest distance between each front flange of a blade in the rear row and the web of an adjacent blade in the front row is approximately equal to the shortest distance between each rear flange of a blade in the front row and the web of an adjacent blade in the rear row and is also approximately equal to the shortest distance between each flange and the flange nearest to it.

27. A louver according to claim 11 wherein the sill has drainage holes near the rear plane for water to drain from the upper surface of the sill into a space below the sill.

28. A louver according to claim 11 wherein all of the blades are the same and each blade is symmetrical about a line in the center of the web parallel to the front and rear planes.

29. A louver according to claim 11 wherein except for no more that two blades adjacent each jamb all adjacent blades in each row are substantially equally spaced apart laterally and the spacing of adjacent blades in the front row is the same as the spacing of the blades in the rear row.

30. A louver according to claim 1 wherein the sill has drainage holes near the rear plane for water to drain from the upper surface of the sill into a space below the sill.

* * * * *